US005403040A

United States Patent [19]

Mowry, Jr. et al.

[11] Patent Number: 5,403,040

[45] Date of Patent: Apr. 4, 1995

[54] OPTICALLY VARIABLE AND MACHINE-READABLE DEVICE FOR USE ON SECURITY DOCUMENTS

[75] Inventors: William H. Mowry, Jr., Dayton; William J. Castle, Beavercreek; Robert L. Neitman, Kettering, all of Ohio

[73] Assignee: The Standard Register Company, Dayton, Ohio

[21] Appl. No.: 859,946

[22] Filed: Mar. 30, 1992

[51] Int. Cl.[6] ..... B42D 15/00

[52] U.S. Cl. ..... 283/91; 283/86; 283/94; 283/904

[58] Field of Search ..... 283/91, 86, 94, 108, 283/903, 904; 350/3.6, 3.61, 3.7, 3.73

[56] References Cited

U.S. PATENT DOCUMENTS

| | | | |
|---|---|---|---|
| 4,033,059 | 7/1977 | Hutton et al. | 40/137 |
| 4,066,280 | 1/1978 | LaCapria | 250/461 R X |
| 4,210,346 | 7/1980 | Mowry, Jr. et al. | 283/58 X |
| 4,227,719 | 10/1980 | McElligott et al. | 283/58 X |
| 4,227,720 | 10/1980 | Mowry, Jr. et al. | 283/58 |
| 4,568,141 | 2/1986 | Antes | 283/91 X |
| 4,677,285 | 6/1987 | Taniguchi | 283/91 X |
| 4,715,623 | 12/1987 | Roulo et al. | 283/91 |
| 4,892,385 | 1/1990 | Webster, Jr. et al. | 283/91 X |
| 4,984,824 | 1/1991 | Antes et al. | 283/91 |
| 5,032,003 | 7/1991 | Antes | 283/91 X |
| 5,074,596 | 12/1991 | Castagnoli | 283/91 |
| 5,106,125 | 4/1992 | Antes | 283/91 |
| 5,199,744 | 4/1993 | Shenton . | |

*Primary Examiner*—Paul A. Bell

*Attorney, Agent, or Firm*—Killworth, Gottman, Hagan & Schaeff

[57] ABSTRACT

An optically variable device for use on security documents to deter unauthorized reproduction is provided which contains a warning message that is not readily apparent to an observer but that reproduces as a visible warning message when copied. The device comprises a pattern of light reflecting surfaces which comprise a reflection diffraction grating having a plurality of grooves that vary in orientation and blaze angle. In an alternative embodiment, a machine-readable optically variable device is provided in which the pattern of specularly light-reflecting surfaces produces a machine-readable message in response to light impinging on the device.

22 Claims, 2 Drawing Sheets

OPTICALLY VARIABLE AND MACHINE-READABLE DEVICE FOR USE ON SECURITY DOCUMENTS

BACKGROUND OF THE INVENTION

This invention relates to an optically variable and machine-readable device for use on security documents, and more particularly, to an optically variable device having a concealed message thereon. The device may be secured to a document, such as a check, money order, or credit card, such that when a duplication attempt is made on digital or analog copiers or printers, a reproduction of the device bears a visible warning message.

It has been estimated that losses at banks and other financial institutions in the United States due to forgery, fraud, and embezzlement amounted to approximately $860 million in 1989. With the increased availability of color copying machines as well as computer-based desktop publishing systems, scanners, and color printers, concern has increased with respect to the possibility of nefarious reproduction of security documents, such as checks and money orders.

Security documents are especially vulnerable to unauthorized reproduction and alteration through the use of optical scanning devices which can input information into a computer desktop publishing system. The desktop publishing system can then output the information to almost any other document.

There have been numerous attempts in the art to incorporate security features or authentication devices into checks and other security documents to deter counterfeiters. For example, Mowry et al, U.S. Pat. Nos. 4,210,346, 4,227,719, and 4,227,720, teach the use of a cancellation phrase, such as "VOID", printed as part of a background pattern on the face of a security document and then hidden from view by a camouflage image. When the document is reproduced on a color copier, limitations of the optical system of the copier cause the cancellation phrase to be visible on the copy.

LaCapria, U.S. Pat. No. 4,066,280, describes a security document that is partially printed with a reflective ink containing a specular reflecting material, such as powdered aluminum. When the document is reproduced on a color copier, the specular reflection from the document cannot be faithfully reproduced on the copy using the toner.

The inability of a color copier system to reproduce specular reflecting materials such as metals has been used by others in attempts to foil counterfeiters. Optically variable devices such as metal foils, prismatic foils, embossed foils, and holographic foils which can be hot stamped onto a security document, have been used. For example, Webster, Jr. et al, U.S. Pat. No. 4,892,385, shows an optically variable authentication device comprising a reflection diffraction grating structure formed as a relief pattern on a document substrate which produces unique optical color properties that cannot be duplicated by color copying machines.

Antes, U.S. Pat. No. 4,568,141, also describes an optical diffraction element for a document which comprises a plurality of adjoining diffraction grating regions having different orientations such that one or more colored patterns are produced as a result of the diffraction of light. The unique patterns function as a visual test for the authenticity of the document.

However, while such optically variable devices may be useful, they do not provide any automatic means of authentication, and the costs of their fabrication and application make them expensive to use for mass produced documents such as checks and money orders. Further, the devices do not provide any visible warning indication to deter persons from attempting to copy the documents.

Accordingly, a need still exists in the art for an inexpensive optically variable device which may be secured to mass produced documents such as checks, money orders, and credit cards which will produce a warning indication to deter counterfeiters who may be using color copying and/or computer-based desktop publishing systems. The need further exists for an optically variable device which will provide automatic authentication of documents.

SUMMARY OF THE INVENTION

The present invention meets that need by providing an optically variable device for use on security documents which is inexpensive to produce and deters unauthorized reproduction by the use of a concealed message on the device which is not readily apparent to the user but reproduces as a visible warning message when copied. The present invention also provides a machine-readable optically variable device for use on substrates. By optically variable, we mean a device which varies in appearance depending upon the point from which it is viewed.

In accordance with one aspect of the present invention, a security document is provided comprising a printed document substrate and an optically variable device secured to the substrate having a concealed warning message therein. The optically variable device comprises a pattern of specular light reflecting surfaces which reproduces as a visible warning message when copies of the document are produced on digital or analog copiers or printers. However, the warning message is not readily apparent on the original document because the specular reflection caused by a normal diffused light source "hides" the message from an observer. Diffused light is directed onto the diffraction grating from all angles while the illuminating light in a copier is directed onto the diffraction grating at one specific angle. Thus, the message becomes readily apparent on a reproduction.

In one embodiment, the pattern of specular light reflecting surfaces comprises a reflection diffraction grating having a plurality of grooves that vary in orientation and blaze angle. The reflection diffraction grating preferably comprises a prismatic foil, but may also comprise a metallic foil, holographic foil, metallized plastic, or an embossed foil. However, the invention is not intended to be limited to these materials, but rather may include any optically variable materials having properties which may reproduce a visible warning message on optical analog or digital printers and copiers. For example, the device may be applied to the surface of a document or as a layer in a laminate with a top transparent layer over the device.

The reflection diffraction grating has rulings between about 3 grooves per millimeter and about 3600 grooves per millimeter, and more preferably, between about 300 grooves per millimeter and about 3000 grooves per millimeter. The blaze angles are preferably between about 5 degrees and 45 degrees. By blaze angles, it is meant the angle on the diffraction grating groove in which light is reflected most strongly.

The warning message on the optically variable device is defined by a plurality of areas having a specific orientation of grooves on the foil. For example, a plurality of grooves may be oriented in one direction on the device in a series of interlocking elements or blocks so that a warning message such as "VOID" is spelled out. Alternatively, if the optically variable device is to be used for authentication purposes, the grooves may be oriented to spell out the word "VALID." The grooves may be oriented and arranged to include any other symbols or statements which, when copied or read by a machine, serve as a warning or indicate authenticity to the user. Preferably, the blaze angles are the same within each block or area of diffraction grating grooves that are oriented in the same direction.

The concealed warning message is designed to reproduce as a visible message on digital or analog copiers or printers, and particularly color copiers or printers. Examples of such color copiers currently in use include the Seiko Mead Cycolor, Canon CLC-1 and CLC-500 digital copiers, as well as the Xerox 1005 analog copier which replaced the earlier Xerox 6500 model. The concealed warning message will also reproduce as a visible message on several other devices, such as desktop publishing systems, scanners and output devices, and digital printers which operate with optical systems similar to those used on copiers.

The optically variable device of the present invention is preferably covered with a transparent material so that it has a smooth surface on the substrate and the device is protected from damage. To insure that a counterfeiter or forger cannot cut and paste a genuine optically variable device onto or into a copy of a security document, it is preferred that the device be attached in such a way as that it is damaged if removal is attempted. The device may be placed on any portion of the document.

In another embodiment of the invention, a machine-readable, optically variable device for use on substrates is provided which comprises a pattern of specular light reflecting surfaces. The pattern produces a machine-readable message in response to light impinging on the surface of the foil material, permitting automatic machine detection of security documents.

In one embodiment, the pattern of specular light reflecting surfaces comprises a reflection diffraction grating having a plurality of grooves that vary in orientation and blaze angle. The machine-readable message on the device is defined by a plurality of areas having a specific orientation of grooves on the foil. The reflection diffraction grating has rulings between about 3 grooves per millimeter and about 3600 grooves per millimeter, and more preferably between about 300 grooves per millimeter and about 3000 grooves per millimeter. The blaze angles are preferably between about 0 degrees and 45 degrees.

The reflection diffraction grating preferably comprises a prismatic foil, but may also comprise a metallic foil, holographic foil, metallized plastic, or an embossed foil.

The optically variable device of the present invention provides inexpensive protection for security documents such as checks and money orders from counterfeiting attempts by the use of color copiers. A counterfeiter attempting to copy a document having the optically variable authentication device thereon will obtain a copy which indicates that the document is void. Further, documents having the machine-readable optically variable device thereon may be processed at a faster rate, and their authenticity will be automatically verified.

Accordingly, it is an object of the present invention to provide a optically variable authentication device and a security document having an optically variable authentication device thereon which is inexpensive to apply and deters unauthorized reproduction by the use of a warning message which is readily apparent only on a reproduction of the device. It is a further object of this invention to provide a machine-readable optically variable device. These and other objects and advantages of the present invention will become apparent from the following detailed description, the accompanying drawings, and the appended claims.

DETAILED DESCRIPTION OF THE PREFERRED EMBODIMENT

In a conventional photocopying process, the document illumination source is positioned to illuminate the document surface and reflect light to the copier optics by means of diffuse reflection. The copier optics do not receive light which is reflected specularly, as this light is nearly as intense as the illumination source.

It is well known that metallized foils produce distinctly distorted images when copied or scanned. The specularly reflected light from a plain foil surface generally misses the copier optics and is therefore not directed to the photoconductive drum surface altogether of a xerographic copier. Consequently, the foil area copies as black or nearly black. Alternatively, in some equipment the foil surface may cause a large portion of the illuminating light to reach the photosensors, producing a completely white reproduction in these areas.

It has been found that by using reflection diffraction gratings in which the grooves vary in blaze angle and in orientation with respect to each other and with respect to the copier optics, some of the gratings reproduce as a white image, some reproduce as a black image, and others reproduce as images of different colors. This discovery has been applied to the present invention wherein a device comprising a pattern of specular reflecting optically variable surfaces is provided. In a preferred embodiment, the device comprises a reflection diffraction grating having a plurality of areas. In each area, the orientation of the grooves and the degree of the blaze angle are uniform. The groove orientation and blaze angle vary from one area to the next, however, such that a visible message appears on a reproduction of the device.

When the original device is illuminated in a photocopy system, the light directed to the original device will be specularly reflected by a number of the areas, i.e. those areas having an appropriate groove orientation. These areas are preferably arranged to collectively form the letters of a warning message, or an authentication message on the reproduction. When the original device is observed under typical illumination conditions, however, light is directed to the device from a number of directions and the areas on the device will reflect various colors of light to the observer's eye. As a consequence, the areas on the original device which collectively form the warning message or authentication message on a reproduction will have various apparent colors on the original device and will not collectively form an easily recognizable message.

Figure 1:
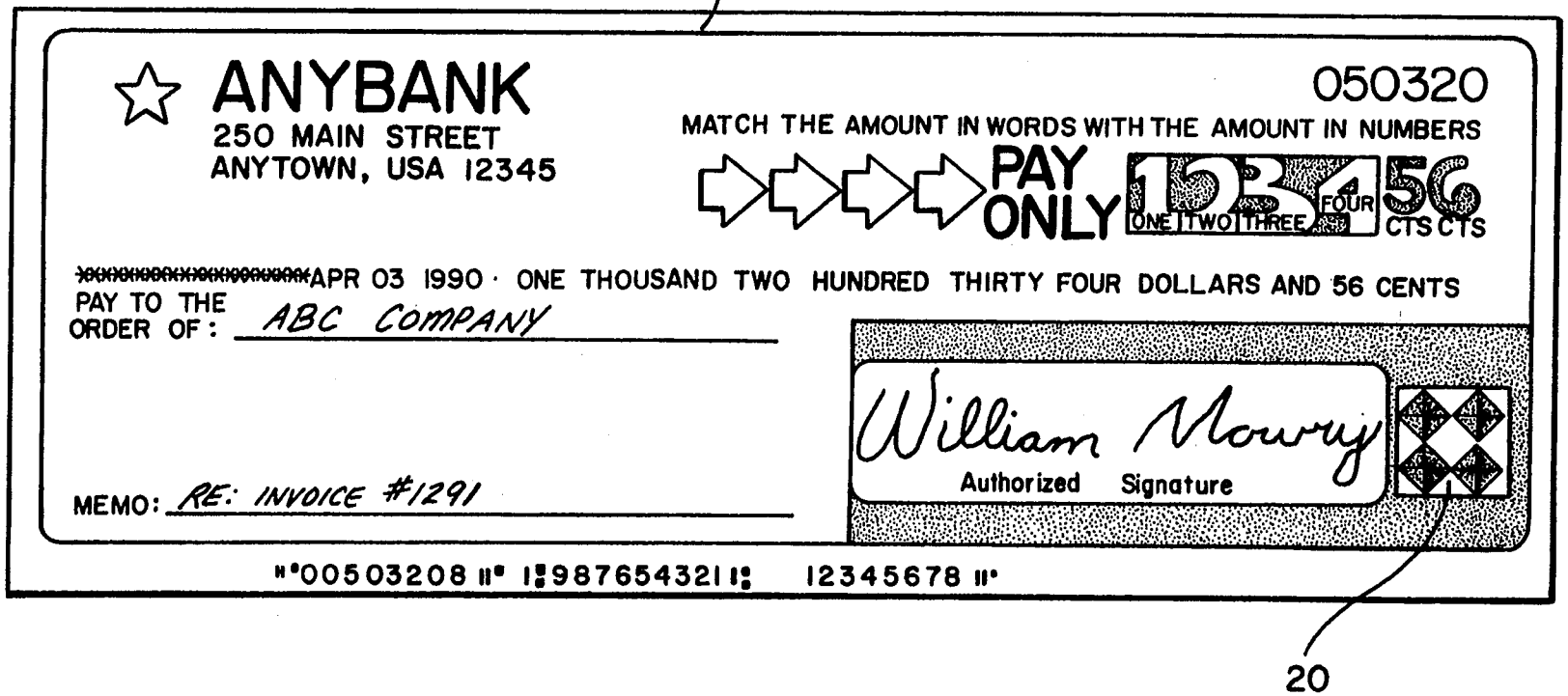
FIG. 1 depicts a plan view of a typical security document in accordance with the present invention showing the optically variable authentication device.
Figure 2:
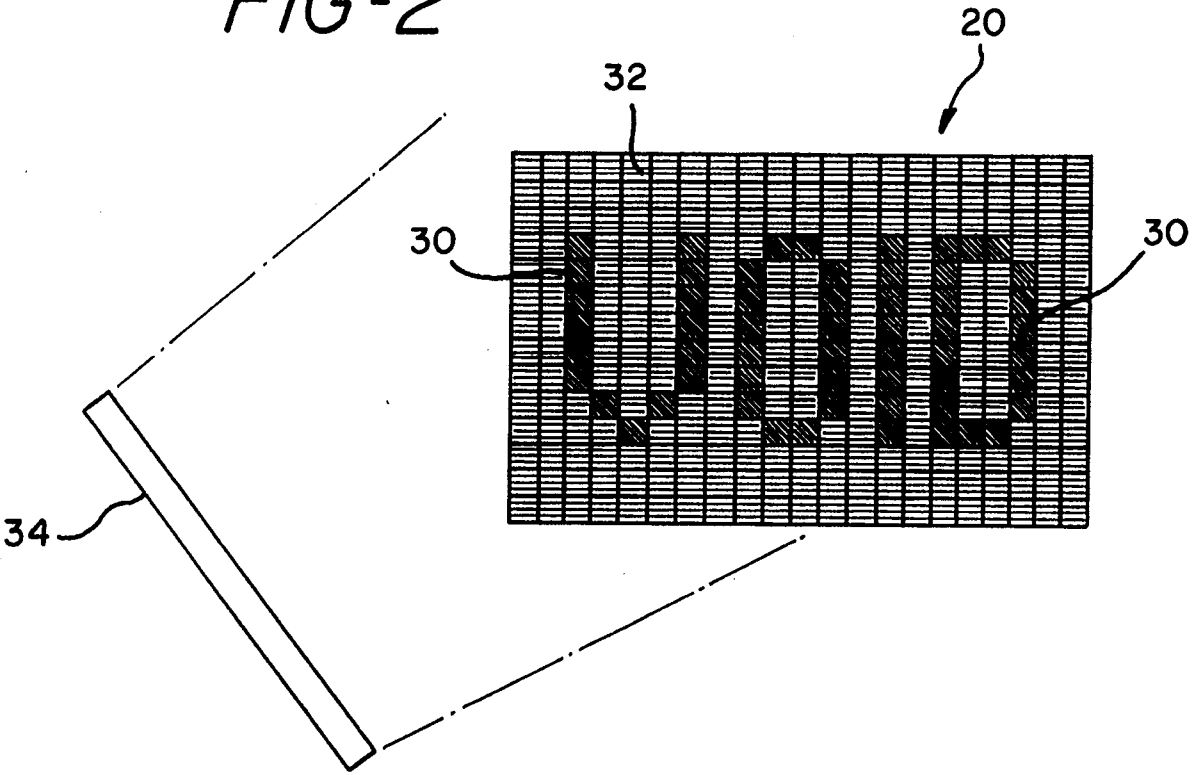
FIG. 2 depicts a plan view of the orientation of reflection diffraction grating grooves of said device.

With reference to FIGS. 1 and 2, it should be appreciated that the Patent and Trademark Office requirements for solid black line drawings on a white surface make illustration of some aspects of the present invention relating to the optically variable device difficult by the drawing alone. However, reference to the detailed description, in conjunction with FIGS. 1 and 2, will make full appreciation of the features of this invention possible.

As shown in FIG. 1, a security document 10, in the form of a check, has an optically variable identification device, such as a reflection diffraction grating 20, mounted thereon. The reflection diffraction grating 20 may be secured to any portion of a document in a permanent manner, such as by hot stamping. The reflection diffraction grating may preferably comprise a prismatic foil. Alternatively, the optically variable identification device may comprise a metallic foil, a holographic foil, a metallized plastic, or an embossed foil. The device may be applied to the surface of a document, or as one layer in a laminate with a top transparent layer over the device. For example, a document may be comprised of a foil material and coated with plastic so that only a portion of it reveals the optically variable device.

FIG. 2 is an enlarged illustration of the optically variable authentication device 20 showing the orientation of reflection diffraction grating grooves 30 on the optically variable device which form the warning word "VOID." As is shown, the reflection diffraction grating may be divided into rows of rectangular areas 32 wherein grooves having a parallel orientation with respect to the illuminating light 34 in a conventional copier appear only in certain blocks which spell out the word "VOID." The grooves in those areas are configured with the same blaze angles while in the surrounding areas the grooves are of a different orientation and different blaze angle. The reflection diffraction grating has rulings between about 3 grooves per millimeter and about 3600 grooves per millimeter, and more preferably between about 300 grooves per millimeter and about 3000 grooves per millimeter. The blaze angles are preferably between about 0 degrees and 45 degrees.

When a document having such an orientation of grooves and blaze angles is copied with approximately the orientation shown, the illuminating light reaches the photoconductive surface of the copier through the copier optics only from those areas in which the grooves are not generally parallel to the illuminating light. As a consequence, all of the areas having gratings oriented in that direction reproduce as black, collectively forming a warning message. While the orientation of grooves forming the message must be generally parallel to the illumination light in the copier in order to be black or nearly so on the reproduction, it should be appreciated that it is possible to arrange other groups of areas of diffraction grating grooves in a number of other orientations so that warning messages will appear on a reproduction regardless of the orientation of the original document on the copier when it is copied.

The device is preferably configured so that a warning message such as "VOID" appears upon copying; however, a message such as "VALID" may also be configured on the device as a means for authenticating a document. The pattern on the optically variable authentication device may be in the form of a symbol, logo, word, mark, or any combination of symbols, logos, words, or marks which may be defined by the orientation and blaze angle of areas made up of reflection diffraction grating grooves. Where the optically variable device is intended to be machine-readable, the pattern is preferably in the form of a message which may be automatically detected.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A security document comprising:

a printed document substrate and an optically variable device secured to said substrate and defining a pattern of specular light reflecting surfaces, said optically variable device varying in appearance depending upon the point from which it is viewed, and said pattern of specular light reflecting surfaces forming a concealed warning message which is not readily apparent when viewed in diffuse light, but which causes a visible warning message to be produced on copies of said document produced on digital or analog copiers or printers.

2. The security document of claim 1 wherein said specular light reflecting surfaces comprise a reflection diffraction grating having a plurality of areas with grooves that vary in orientation and blaze angle.

3. The security document of claim 2 wherein said reflection diffraction grating comprises a prismatic foil.

4. The security document of claim 2 in which said reflection diffraction grating comprises a metallic foil.

5. The security document of claim 2 in which said reflection diffraction grating comprises a holographic foil.

6. The security document of claim 2 in which said reflection diffraction grating comprises a metallized plastic.

7. The security document of claim 2 in which said reflection diffraction grating comprises an embossed foil.

8. The security document of claim 2 in which said warning message is defined by a plurality of areas having substantially the same orientation of grooves on said foil.

9. The security document of claim 2 wherein said reflection diffraction grating has rulings between about 3 grooves per millimeter and about 3600 grooves per millimeter.

10. The security document of claim 2 wherein said reflection diffraction grating has rulings between about 300 grooves per millimeter and about 3000 grooves per millimeter.

11. The security document of claim 2 wherein said blaze angles are between about 5 degrees and 45 degrees.

12. An optically variable device for use on security documents comprising:

a device defining a pattern of specular light reflecting surfaces, said optically variable device varying in appearance depending upon the point from which it is viewed, and said pattern forming a concealed warning message which is not readily apparent when viewed in diffuse light, but which causes a visible warning message to be produced on copies produced on digital or analog copiers or printers.

13. The optically variable device of claim 12 wherein said pattern of specular light reflecting surfaces comprise a reflection diffraction grating having a plurality of areas with grooves that vary in orientation and blaze angle.

14. The optically variable device of claim 13 wherein said reflection diffraction grating comprises a prismatic foil.

15. The optically variable device of claim 13 in which said reflection diffraction grating comprises a metallic foil.

16. The optically variable device of claim 13 in which said reflection diffraction grating comprises a holographic foil.

17. The optically variable device of claim 13 in which said reflection diffraction grating comprises a metallized plastic.

18. The optically variable device of claim 13 in which said reflection diffraction grating comprises an embossed foil.

19. The optically variable device of claim 13 in which said warning message is defined by a plurality of areas having substantially the same orientation of grooves on said foil.

20. The optically variable device of claim 13 wherein said reflection diffraction grating has rulings between about 3 grooves per millimeter and about 3600 grooves per millimeter.

21. The optically variable device of claim 13 wherein said reflection diffraction grating has rulings between about 300 grooves per millimeter and about 3000 grooves per millimeter.

22. The optically variable device of claim 13 wherein said blaze angles are between about 5 degrees and 45 degrees.

* * * * *